US007210639B2

(12) United States Patent
Magel

(10) Patent No.: US 7,210,639 B2
(45) Date of Patent: May 1, 2007

(54) SERVO-VALVE-CONTROLLED FUEL INJECTOR

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 146 days.

(21) Appl. No.: 11/092,751

(22) Filed: Mar. 30, 2005

(65) Prior Publication Data

US 2005/0224599 A1 Oct. 13, 2005

(30) Foreign Application Priority Data

Apr. 8, 2004 (DE) ..... 10 2004 017 304

(51) Int. Cl.
*F02M 47/02* (2006.01)
*B05B 1/30* (2006.01)

(52) U.S. Cl. ..... 239/88; 239/89; 239/90; 239/91; 239/124; 239/533.2; 239/585.1; 123/446; 123/467; 123/506; 132/624.65

(58) Field of Classification Search ..... 239/88, 239/89, 90, 91, 93, 96, 124, 533.2, 585.1; 123/446, 467, 447; 137/625.64, 625.65
See application file for complete search history.

(56) References Cited

U.S. PATENT DOCUMENTS 3,802,626 A * 4/1974 Regneault et al. ..... 239/96
5,669,355 A * 9/1997 Gibson et al. ..... 123/446
5,687,693 A * 11/1997 Chen et al. ..... 123/446
5,975,139 A * 11/1999 Carroll et al. ..... 137/625.64

* cited by examiner

*Primary Examiner*—Dinh Q. Nguyen
(74) *Attorney, Agent, or Firm*—Ronald E. Greigg

(57) ABSTRACT

A fuel injector having an injection valve connected to a high-pressure source and a control valve including a control piston guided in a valve body and comprising a pressure piston section having a first pressure surface guided in a bush and a control piston section with a sliding seal that has a control edge; the bush is contained in a pressure chamber of the valve body. In a first valve position, a sealing seat of the control piston disconnects a valve chamber from a low-pressure/return system and in a second valve position, the control edge of the control piston disconnects the pressure chamber from the valve chamber; in the second valve position, a connection is simultaneously produced between the valve chamber and the low-pressure/return system, thus initiating an actuation of the fuel injection valve. The control piston section with the control edge is guided in a control cylinder that is contained in the pressure chamber of the valve body and is separate from the bush.

20 Claims, 1 Drawing Sheet

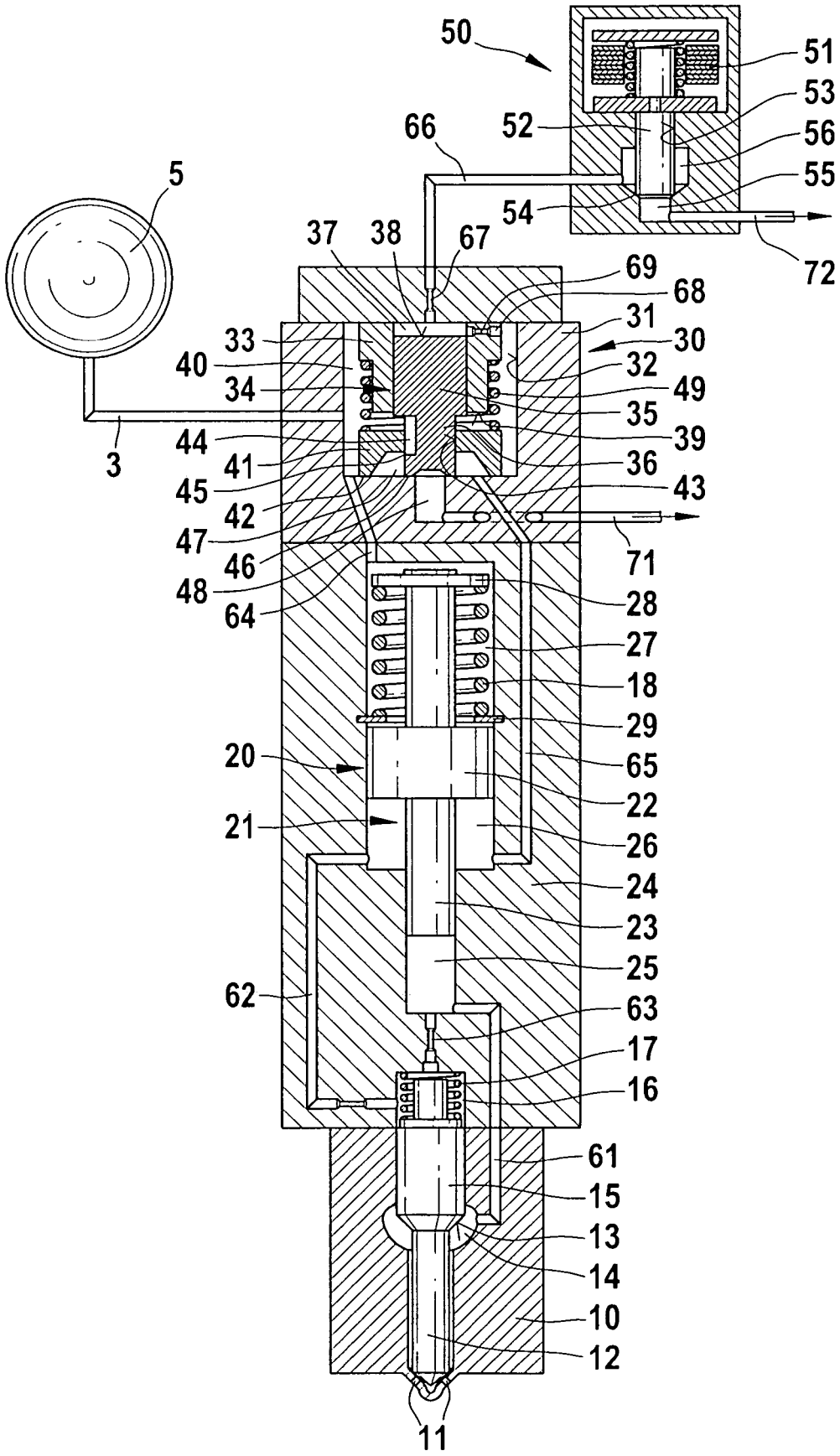
50
51
53
52
56
66
55
5
54
37
38
67
72
69
68
31
33
30
40
32
34
49
35
44
39
3
41
36
45
43
42
47
71
46
48
28
64
27
18
29
20
65
22
21
26
24
23
25
62
63
17
16
61
15
13
14
10
12
11

SERVO-VALVE-CONTROLLED FUEL INJECTOR

BACKGROUND OF THE INVENTION

1. Field of the Invention

The invention relates to an improved fuel injector for internal combustion engines.

2. Description of the Prior Art

DE 101 23 913 A1 has disclosed a fuel injector for internal combustion engines, having a pressure boosting unit for boosting pressure and having a servo-valve for triggering the fuel injector in a pressure-controlled manner. The servo-valve, which is embodied in the form of a 3/2-way control valve, is triggered by and on/off valve embodied in the form of the solenoid valve that executes the pressure control of the fuel injector. The control valve is equipped with a control piston that can move longitudinally in a bore and has a control edge that disconnects a high-pressure system from a low-pressure system. The control piston of the control valve must be provided with various pressure chambers to permit the connection of control lines, the insides of which are subjected to the high pressure of the injection system. This exertion of pressure results in the dilatation of leakage points along high-pressure-tight guides, deformations and dilatations at the control edges of sliding seals, and high notch stresses at bore intersections. These effects due to the exertion of pressure impair the function of the control valve and consequently reduce its fatigue strength.

German patent application 103 37 574.0 has already proposed guiding the control piston in a bush that is externally subjected to system pressure. This significantly reduces dilatations of the high-pressure-tight guides and control edges, deformations of the valve, and high notch stresses at bore intersections. However, it is disadvantageous that the control piston must be ground to fit the bush at two different diameters, which entails high production costs.

OBJECT AND SUMMARY OF THE INVENTION

The fuel injector according to the present invention has the advantage that the pressure piston section and the control piston section of the control piston, which are embodied with different diameters, are guided in separate respective guide elements. It is consequently unnecessary to provide double guidance in a single guide element for the different diameters of these sections of the control piston, which reduces cost of producing the control valve. This also improves technical manufacturing-related controllability and reproducibility for serial production. At the same time, the forces of pressure acting in the control valve, against the control piston, and on the components connected with it, are compensated for, as a result of which the deformation forces exerted in the control valve are kept to a minimum. Therefore high notch stresses do not occur in the components, e.g. at bore intersections, so that the resulting stresses remain significantly lower than fatigue strength values.

It is particularly useful if the control cylinder encompasses the valve chamber and, in the pressure-balanced state when the sealing seat of the control piston is closed, a connecting conduit that cooperates with the control edge produces a hydraulic connection between the pressure chamber and the valve chamber. It is also useful if the control cylinder is provided with an additional sealing seat in the control chamber, which in the depressurized state, disconnects the pressure chamber from a valve chamber provided in the valve body. In this state, the connecting conduit between the pressure chamber and the valve chamber is simultaneously closed. The control piston is suitably embodied so that it has a closing pressure surface in a control chamber and an opening pressure surface that is acted on by the system pressure and exposed to the pressure chamber. In the inactive state of the fuel injector, the sealing seat of the control piston is closed and the sliding seal with the control edge on the control cylinder is open. In the active state of the fuel injector, the sealing seat of the control piston is open and the sliding seal with the control edge on the control cylinder is closed.

The movement of the control piston can be set to any desired speed by suitably matching a first throttle, which produces a connection between the control chamber and a control chamber in the vicinity the actuator, to a second throttle, which produces a connection between the control chamber and the high-pressure chamber. A constant, definite opening force acts on the control piston due to the system pressure continouously exerted against the opening pressure surface. This yields a precise valve movement and a causes the control piston to stably remain against the opening stop in the open state. As a result, it is possible to implement a slow opening motion of the control piston, thus permitting a stable partial opening, which makes it possible for the injection of an extremely small quantity to be reliably set.

The control edge between the control piston section of the control piston and the valve body can be embodied in a multitude of ways. The use of a flat seat for the sealing seat intended to seal the pressure chamber in relation to the low-pressure/return system is particularly suitable because this makes it possible to compensate for a potentially occurring axial offset of the components. In addition, the closing force of pressure by means of the pressure surface of the control piston provides enough closing force to assure a sufficiently high surface pressure against the flat seat to produce a good seal. It is also possible to assist the valve movement of the control piston by allowing additional spring forces to act on the control piston.

It is particularly suitable to use the control valve in conjunction with a pressure boosting unit that is connected between the high-pressure source and the injection valve; the pressure boosting unit has a differential pressure chamber that cooperates with a pressure booster piston and can be controlled by the control valve so that a pressure change in the pressure chamber causes a boosting of the pressure acting on the injection valve.

BRIEF DESCRIPTION OF THE DRAWING

The invention will be better understood and further objects and advantages thereof will become more apparent from the ensuing detailed description of preferred embodiments, taken in conjunction with the drawings, in which the sole FIGURE shows a schematic, sectional view of a fuel injector according to the present invention.

DESCRIPTION OF THE PREFERRED EMBODIMENTS

The fuel injector shown in the sole FIGURE is connected to a high-pressure fuel source 5 via a fuel line 3. High-pressure fuel source 5 has a number of elements that are not shown, including a fuel tank, a high-pressure pump, and a high-pressure line, for example an intrinsically known common rail system in which the pump delivers a high fuel pressure of up to 1600 bar via the high-pressure line. The fuel injector also has a fuel injection valve 10 whose injection openings 11 protrude into a combustion chamber of an internal combustion engine.

The fuel injection valve 10 has a closing piston 12, which is embodied in the form of a valve needle and has a pressure shoulder 13 encompassed by a pressure chamber 14. At an end oriented away from the combustion chamber, the closing piston 12 is guided in a guide region 15 that adjoins a closing pressure chamber 16. A closing spring 17 prestresses the closing piston 12 in the closing direction.

To boost the pressure, the fuel injector also has a pressure boosting unit 20. The pressure boosting unit 20 has a booster piston 21, which is supported in a sprung fashion by a return spring 18 and has a first partial piston 22 and a smaller-diameter second partial piston 23. The partial pistons 22, 23 are associated with a corresponding diametrically stepped cylinder 24 so that the smaller-diameter partial piston 23 separates a high-pressure chamber 25 in the cylinder 24 from a differential pressure chamber 26 in a fluid-tight fashion. The larger-diameter first partial piston 22, which is guided in the larger-diameter cylinder section of the cylinder 24, also separates the differential pressure chamber 26 from a pressure boosting chamber 27 in a fluid-tight fashion. The pressure boosting chamber 27 contains the return spring 18 that is prestressed between a spring retainer 28 and a ring element 29 in order to produce an appropriate return movement for the booster piston 21.

The fuel injector also has a servo-valve that includes a hydraulic control valve 30 and an electrically actuatable on/off valve 50 that is actuated by an electromagnetic or piezoelectric actuator 51. Connected to the actuator 51, the control valve 50 has an actuator piston 52 that is guided in an actuator bore 53. In cooperation with an actuator sealing seat 54, the actuator piston 52 shuts off a low-pressure chamber 55 of the actuator from a control chamber 56 of the actuator in a fluid-tight fashion.

The control valve 30 has a valve body 31 with a receptacle 32. The receptacle 32 contains a bush 33 in which a pressure piston section 35 of a control piston 34 is guided. The control piston 34 also has a control piston section 36 that has a smaller diameter than the pressure piston section 35. The control piston section 36 has a guide region with a control edge 45 that functions as a sealing edge. The guide region of the control piston section 36 is guided in a piston guide 43 of a control cylinder 41; the control cylinder 41 is likewise contained in the receptacle 32 and functions as a guide element for control piston 34, which guide element is separate from the bush 33. On the pressure piston section 35, the control piston 34 has a pressure surface 38 facing into a control chamber 37. Between the pressure piston section 35 and the control piston section 36, there is an annular surface that constitutes an opening pressure surface 39 that will be explained in greater detail below.

The receptacle 32 constitutes a pressure chamber 40 in which system pressure is externally exerted on the bush 33 and the control cylinder 41. The end surface of the control piston section 36 is provided with a sealing seat 46 that cooperates with the bottom surface of the pressure chamber 40 and separates a valve chamber 47 inside the control cylinder 41 from a connecting chamber 48 connected to a low-pressure/return system. The control cylinder 41 also has an end surface with a sealing surface or sealing edge that constitutes an additional sealing seat 42 at the bottom of the receptacle 32, separating the pressure chamber 40 from the valve chamber 47. A compression spring 49 acts on the control cylinder 41 and presses the sealing seat 42 against the bottom surface of the pressure chamber 40, particularly in the depressurized state. In the guide region of the control piston section 36, a connecting conduit 44 is provided, which cooperates with the control edge 45 and, when the sealing seat 46 is closed, produces a hydraulic connection between the pressure chamber 40 and the valve chamber 47.

The individual components of the injection valve 10, pressure boosting unit 20, control valve 30, and on/off valve 40 are connected by pressure lines that are, for example, integrated into the fuel injector. A first pressure line 61 connects the pressure chamber 14 of the injection valve 10 to the high-pressure chamber 25 of the pressure boosting unit 20. From the closing chamber 16 of the injection valve 10, a second pressure line 62 leads to the differential pressure chamber 26 of the pressure boosting unit 20. There is also a connecting line 63 with a throttle between the closing pressure chamber 16 and a high-pressure chamber 25. The hydraulic pressure of the high-pressure fuel source 5 travels through the high-pressure line 3 into the pressure chamber 40 and from there, via a pressure chamber line 64, into the pressure boosting chamber 27 of the pressure boosting unit 20. The pressure boosting chamber 27 is thus connected to the pressure chamber 40 of the control valve 30. A differential pressure chamber line 65 connects the differential pressure chamber 26 of the pressure boosting unit 20 to the valve chamber 47 of the control valve 30. A first return line 71 leads from the connecting chamber 48, through the low-pressure/return system, and back into a fuel tank that is not shown. A control line 66 provided with an outlet throttle 67 connects the control chamber 37 of the control valve 30 to the actuator control chamber 56 of the on/off valve 50. A second return line 72 leads from the actuator low-pressure chamber 55 of the on/off valve 50 into the low-pressure/return system. The return lines 71, 72 can also be embodied in the form of a combined return system. Finally, a connecting bore 68 leads from the control chamber 37, via an inlet throttle 69, and into the pressure chamber 40 of the control valve 30.

The fuel injector functions as follows: at the beginning of the injection process, as a result of the constant pressure in the high-pressure chamber 5, the pressure prevailing in the pressure boosting chamber 27 is also present in the differential pressure chamber 26 via the differential pressure chamber line 65 and is also present in the high-pressure chamber 25 via the second pressure line 62 and the connecting line 63 and from there, is also present in the pressure chamber 14 of the injection valve 10 via the first pressure line 61. The actuator 51 of the on/off valve 50, which in the present exemplary embodiment is a solenoid valve, is supplied with current so that the actuator piston 52 disconnects the control line 66, which communicates with the control chamber 37 of the control valve 30, from the actuator low-pressure chamber 55 that communicates with the second return line 72. As a result, the system pressure or rail pressure prevailing in the pressure chamber 40 travels into the control chamber 37 via the connecting bore 68. The high-pressure prevailing in the control chamber 37 acts on the pressure surface 38 and presses the sealing seat 46 of the control piston 41 against the bottom surface of the pressure chamber 40 so that the sealing seat 46 shuts off the connecting chamber 48 that communicates with the return line 71. In this position of the control piston 41, the control edge 45 is positioned outside the piston guide 43 of the valve body 31 so that a hydraulic connection is produced between the pressure chamber 40 and the valve chamber 47 via the connecting conduit 44. The first return line 71 is consequently decoupled from the high pressure or system pressure and the injection valve 10 is closed.

The opening stroke motion of the closing piston 12 of the injection valve 10 is initiated by correspondingly supplying current to the actuator 51 to lift the actuator piston 52 away from the actuator sealing seat 54 so that the control chamber 37 is connected to the actuator control chamber 56 and the actuator low-pressure chamber 55. The flow resistances of the inlet throttle 69 and the outlet throttle 67 are dimensioned so that the pressure in the control chamber 37 drops and the end surface of the control piston section 36 of the control piston 34 lifts away from the sealing seat 46 and at the same time, the control edge 45 on the piston guide 43 closes the connecting conduit 44. This disconnects the valve chamber 47 from the rail or system pressure prevailing in the pressure chamber 40 and at the same time, the differential pressure chamber line 65 that leads into the valve chamber 47 is connected via the connecting chamber 48 to the return line 71 and therefore to the low-pressure system. Consequently, the pressure prevailing in the differential pressure chamber 26 of the pressure boosting unit 20 is relieved via the return line 71 and the pressure drops in the differential pressure chamber 26. As a result, the pressure boosting unit 20 is activated and the second partial piston 23 with the smaller effective area compresses the fuel in the high-pressure chamber 25 so that in the pressure chamber 14 connected to the high-pressure chamber 25, the force of pressure acting on the pressure shoulder 13 in the opening direction increases and the closing piston 12 lifts away from the injection openings. The pressure boosting unit 20 remains activated and compresses the fuel in the high-pressure chamber 25 for as long as the differential pressure chamber 26 remains depressurized.

In order to terminate the injection process, the on/off valve 50 is switched back into its starting position. As a result, the placement of the control piston 34 against the sealing seat 46 disconnects the differential pressure chamber 26 of the pressure boosting unit 20 from the return line 71 and causes it to be acted on with system pressure again via the valve chamber 47, the connecting conduit 44, and the pressure chamber 40. The system pressure also travels into the differential pressure chamber 26 via the return line 65, thus moving the pressure booster piston 21 back into its starting position assisted by the return spring 18. As a result, the pressure in the high-pressure chamber 25 falls to the system pressure, which means that system pressure once again prevails in the pressure chamber 14 and the high-pressure chamber 25 is filled from the fuel source 5 via the connecting line 63. The system pressure also exerted via the second pressure line 62 returns the closing piston 12 to its starting position, assisted by the closing spring 17 contained in the closing pressure chamber 16.

The foregoing relates to preferred exemplary embodiments of the invention, it being understood that other variants and embodiments thereof are possible within the spirit and scope of the invention, the latter being defined by the appended claims.

I claim:

1. In a fuel injector for internal combustion engines, having a fuel injection valve (10) connected to a high-pressure source and having a control valve (30) that includes a control piston (34) that is guided in a longitudinally movable fashion in a valve body (31) and comprises a pressure piston section (35), which has a first pressure surface (38) and is guided in a bush (33), and a control piston section (36) with a sliding seal that has a control edge (45); the bush (33) is contained in a pressure chamber (40) of the valve body (31) and is at least partially acted on from the outside with system pressure; in a first valve position, a sealing seat (46) of the control piston (34), which sealing seat (46) is acted on by means of the pressure surface (38), disconnects a valve chamber (47) from a low-pressure/return system and in a second valve position, the control edge (45) of the control piston (34) disconnects the pressure chamber (40) from the valve chamber (47) and simultaneously, via the sealing seat (46), produces a connection between the valve chamber (47) and the low-pressure/return system, thus initiating an actuation of the fuel injection valve (10), the improvement wherein the control piston section (36) of the control piston (34) with the control edge (45) is guided in a control cylinder (41) that is contained in the pressure chamber (40) of the valve body (31) and is separate from the bush (33).

2. The fuel injector according to claim 1, further comprising a connecting conduit (44) that cooperates with the control edge (45), the connecting conduit (44) being embodied in a guide region of the control piston section (36) in such a way that in the deactivated state, when the sealing seat (46) of the control piston (34) is closed, there is a hydraulic connection between the pressure chamber (40) and the valve chamber (47).

3. The fuel injector according to claim 1, wherein the control cylinder (41) comprises an additional sealing seat (42) that disconnects the pressure chamber (40) from the valve chamber (47) when the valve chamber (47) is in the depressurized state.

4. The fuel injector according to claim 2, wherein the control cylinder (41) comprises an additional sealing seat (42) that disconnects the pressure chamber (40) from the valve chamber (47) when the valve chamber (47) is in the depressurized state.

5. The fuel injector according to claim 1, further comprising a compression spring (49) that acts on the control cylinder (41) in the closing direction of the additional sealing seat (42).

6. The fuel injector according to claim 2, further comprising a compression spring (49) that acts on the control cylinder (41) in the closing direction of the additional sealing seat (42).

7. The fuel injector according to claim 3, further comprising a compression spring (49) that acts on the control cylinder (41) in the closing direction of the additional sealing seat (42).

8. The fuel injector according to claim 1, wherein the control piston (34) comprises an opening pressure surface (39) that is exposed to the pressure chamber (40), is subjected to the system pressure, and continually acts on the sealing seat (46) in the opening direction.

9. The fuel injector according to claim 1, wherein the pressure surface (38) delimits a control chamber (37) inside the bush, and further comprising an on/off valve (50) which can switch between connecting this control chamber (37) to the system pressure and connecting it to the low-pressure/return system.

10. The fuel injector according to claim 1, wherein the sealing seat (46) of the control piston (34) is provided with a flat seat.

11. The fuel injector according to claim 1, wherein system pressure is externally exerted on the control cylinder (41) at least partially inside the pressure chamber (40).

12. The fuel injector according to claim 2, wherein system pressure is externally exerted on the control cylinder (41) at least partially inside the pressure chamber (40).

13. The fuel injector according to claim 3, wherein system pressure is externally exerted on the control cylinder (41) at least partially inside the pressure chamber (40).

14. The fuel injector according to claim 4, wherein system pressure is externally exerted on the control cylinder (41) at least partially inside the pressure chamber (40).

15. The fuel injector according to claim 5, wherein system pressure is externally exerted on the control cylinder (41) at least partially inside the pressure chamber (40).

16. The fuel injector according to claim 8, wherein system pressure is externally exerted on the control cylinder (41) at least partially inside the pressure chamber (40).

17. The fuel injector according to claim 9, wherein system pressure is externally exerted on the control cylinder (41) at least partially inside the pressure chamber (40).

18. The fuel injector according to claim 10, wherein system pressure is externally exerted on the control cylinder (41) at least partially inside the pressure chamber (40).

19. The fuel injector according to claim 1, wherein the control valve (30) controls a pressure boosting unit (20), which is equipped with a pressure booster piston (21) and is connected between the high-pressure source (5) and the injection valve (10).

20. The fuel injector according to claim 19, wherein the pressure boosting unit (20) has a differential pressure chamber (26), which cooperates with the pressure booster piston (21) and can be controlled by the control valve (30) so that a pressure decrease in the pressure chamber (26) causes a boosting of the pressure acting on the injection valve (10).

* * * * *